US006035935A

United States Patent [19]

Regalbuto

[11] Patent Number: 6,035,935

[45] Date of Patent: Mar. 14, 2000

[54] METHOD FOR ESTABLISHING CONNECTIVITY BETWEEN LATERAL AND PARENT WELLBORES

[75] Inventor: John A. Regalbuto, Ft. Worth, Tex.

[73] Assignee: Halliburton Energy Services, Inc., Dallas, Tex.

[21] Appl. No.: 09/083,318

[22] Filed: May 22, 1998

[51] Int. Cl.[7] ..... E21B 29/02; E21B 19/16

[52] U.S. Cl. ..... 166/298; 175/81; 166/378

[58] Field of Search ..... 166/297, 298, 166/381, 378, 382; 175/77, 78, 81, 108

[56] References Cited

U.S. PATENT DOCUMENTS

| | | | |
|---|---|---|---|
| 2,407,093 | 9/1946 | Mohaupt | 164/85 |
| 2,684,030 | 7/1954 | Muskat et al. | 102/20 |
| 2,686,472 | 8/1954 | Burns | 102/20 |
| 2,758,543 | 8/1956 | Grandin | 102/21.6 |
| 2,935,020 | 5/1960 | Howard et al. | 102/20 |
| 2,935,021 | 5/1960 | Niles | 102/20 |
| 2,935,038 | 5/1960 | Chatten | 113/44 |
| 3,034,178 | 5/1962 | Cartier et al. | 18/59.3 |
| 3,165,057 | 1/1965 | Armstrong | 102/24 |
| 3,225,828 | 12/1965 | Wisenbaker et al. | 166/298 X |
| 3,335,664 | 8/1967 | Enzian | 102/24 |
| 4,116,130 | 9/1978 | Christopher et al. | 102/20 |
| 4,151,798 | 5/1979 | Ridgeway | 102/24 |
| 4,354,433 | 10/1982 | Owen | 102/307 |
| 4,505,018 | 3/1985 | Regalbuto et al. | 29/432 |
| 4,889,187 | 12/1989 | Terrell et al. | 166/298 |
| 5,388,648 | 2/1995 | Jordan, Jr. | 166/117.5 X |
| 5,458,209 | 10/1995 | Hayes et al. | 175/61 |
| 5,467,824 | 11/1995 | DeMarsh et al. | 166/297 |
| 5,484,021 | 1/1996 | Hailey | 166/297 |
| 5,525,010 | 6/1996 | Kenny et al. | 405/195.1 |
| 5,636,692 | 6/1997 | Haugen | 166/298 |
| 5,697,438 | 12/1997 | Rehbock et al. | 166/117.5 X |
| 5,709,265 | 1/1998 | Haugen et al. | 166/55.2 |

OTHER PUBLICATIONS

Jet Research Center; "Linear Shaped Charge"; Feb. 1, 1970; 15 pages.

Jet Research Center; Explosive Services; Nov. 1996; 7 pages.

*Primary Examiner*—Frank Tsay
*Attorney, Agent, or Firm*—William M. Imwalle; Marlin R. Smith

[57] ABSTRACT

A method of interconnecting wellbores is provided which is convenient and economical in its performance. In a described embodiment, milling is not required for forming an opening through a sidewall of casing positioned in a parent wellbore. Instead, an appendage is formed from the casing sidewall and deformed outwardly into a void. A lateral wellbore may then be drilled through the casing sidewall. A liner may be positioned in the lateral wellbore and attached to the appendage.

30 Claims, 6 Drawing Sheets

METHOD FOR ESTABLISHING CONNECTIVITY BETWEEN LATERAL AND PARENT WELLBORES

BACKGROUND OF THE INVENTION

The present invention relates generally to operations performed in conjunction with subterranean wells and, in an embodiment described herein, more particularly provides methods for interconnecting wellbores.

Wellbore junctions are formed when a second wellbore is drilled intersecting a first wellbore. In a typical drilling program, the first wellbore may be designated a "parent" or "main" wellbore, and the second wellbore may be designated a "lateral" or "branch" wellbore. Depending upon the type of well, the type of formation surrounding the wellbore junction, etc., it is usually important for the completed wellbore junction to provide access to the parent wellbore above and below the junction, and to provide access to the lateral wellbore, and for the wellbore junction to prevent migration of fluids between formations intersected by the wellbores. It is also important for the casing, liners, or other tubular members installed at or through the junction to be isolated from fluid communication with the formation surrounding the junction.

Of course, it is additionally important for the wellbore junction formation operation to be convenient and efficient, in order to save valuable rig time, and for the resulting junction to be reliable and long-lasting. Unfortunately, most prior methods of forming wellbore junctions have required time-consuming milling operations, in which openings are formed laterally through casing positioned in the parent wellbores at the junctions. The openings are formed so that cutting tools, such as drill bits, reamers, etc., may be passed through the openings in order to drill lateral wellbores extending outwardly from the parent wellbores. It would, therefore, be highly advantageous to provide methods of interconnecting wellbores which do not require milling through a casing sidewall downhole prior to drilling a lateral wellbore.

It is accordingly an object of the present invention to provide such methods. Other objects and advantages of the present invention are set forth below.

SUMMARY OF THE INVENTION

In carrying out the principles of the present invention, in accordance with an embodiment thereof, a method is provided which does not require milling through a casing sidewall downhole, but which conveniently and economically interconnects parent and lateral wellbores. The method makes use of explosives technology to permit an opening to be formed quickly through a casing sidewall. An additional benefit of the method is that a liner or other tubular member positioned in a lateral wellbore may be attached to a portion of a casing or other tubular member positioned in a parent wellbore, thereby accurately anchoring the liner to the casing and strengthening the wellbore junction.

In broad terms, a method of interconnecting first and second wellbores is provided which includes the steps of positioning a first tubular member in a first wellbore, forming an appendage from a portion of a sidewall of the first tubular member, with the appendage remaining attached to the remainder of the first tubular member, and outwardly bending the appendage into a void external to the first tubular member. A second tubular member may be attached to the appendage after a second wellbore has been drilled extending outward from an opening created by bending the appendage away from the remainder of the first tubular member. The appendage may be bent outward by means of a mandrel or another apparatus which is laterally expanded within the first tubular member in response to fluid pressure applied thereto.

In another aspect of the present invention, a portion of a tubular member is deformed outwardly into a void external to the tubular member. The void may be formed by underreaming a wellbore, or it may be formed by explosively compacting a formation surrounding the tubular member. Where the explosive compacting method is used, explosive devices may be detonated within the tubular member to cause compaction of the formation.

In another aspect of the present invention, an appendage is formed from a sidewall portion of a tubular member by detonating a linear shaped charge within the tubular member. Such detonation cuts a generally U-shape through the casing sidewall. This U-shape appendage may then be deformed outwardly while remaining attached to the tubular member.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
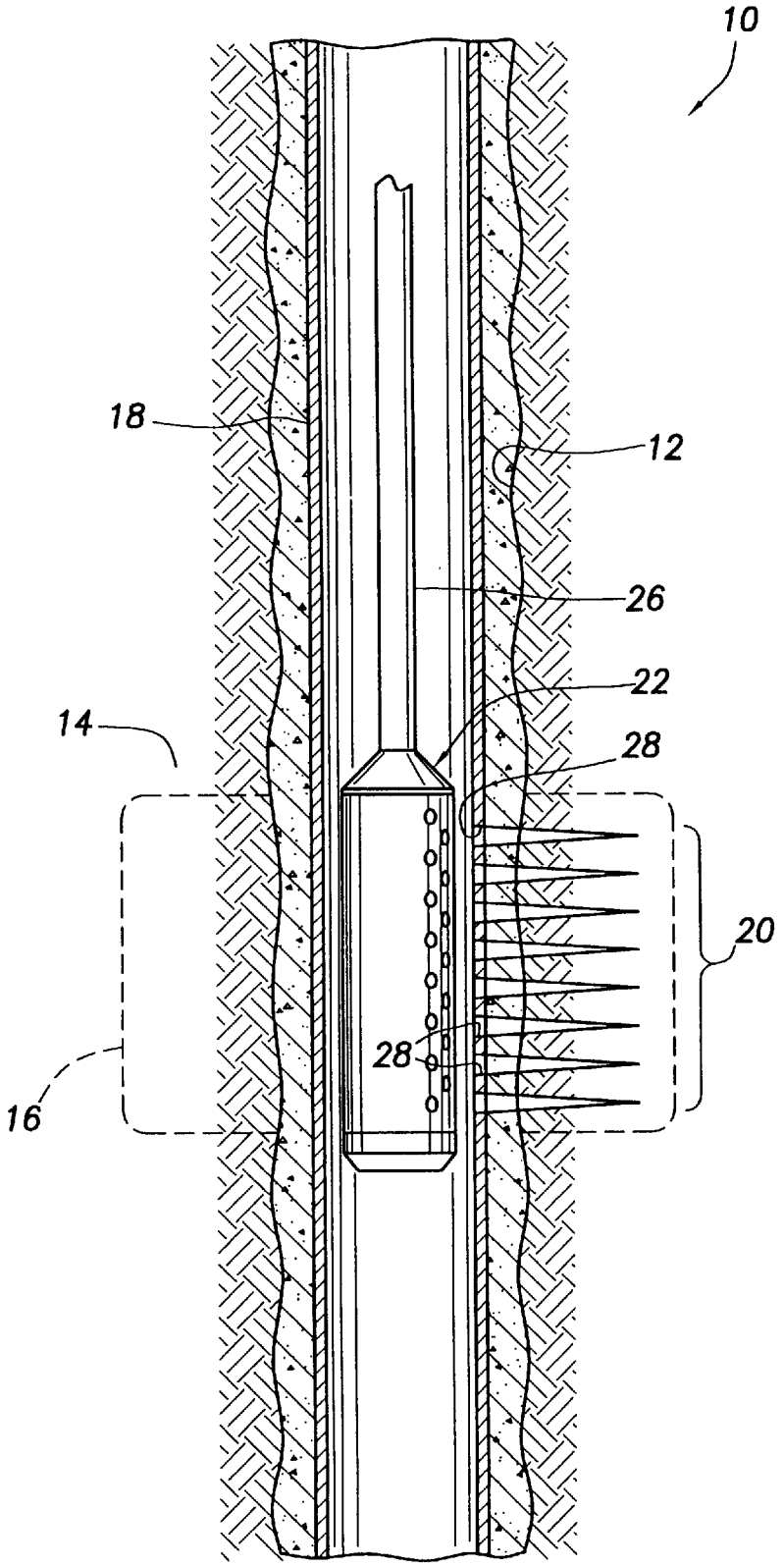
FIG. 1 is a partially cross-sectional and partially elevational view of a method of interconnecting wellbores in which initial steps of the method have been performed, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

As viewed in FIG. 1, initial steps of the method have been performed. A first or parent wellbore 12 has been drilled intersecting an earthen strata or formation 14. In an optional variation of the method 10, a portion of the parent wellbore 12 may be underreamed (indicated by dashed lines 16) or otherwise radially enlarged to form a void prior to positioning a tubular member or casing 18 in the parent wellbore. If not underreamed or otherwise radially enlarged prior to installing the casing 18, a recess or void 20 may nevertheless be formed after the casing has been installed and cemented in place.

Preferably, where the method 10 is performed in conjunction with initial drilling of the well, the parent wellbore 12 is underreamed or otherwise radially enlarged to form a void or recess in the wellbore prior to installing the casing 18. However, due to unique features of the method 10 described more fully below, the void 20 may still be formed, even though the casing 18 has already been installed. Thus, the method 10 may be performed with new wells, or with existing wells or wells that have been at least partially completed. In the remainder of the description of the method 10 below, the method will be described as though the void 20 is formed in the formation 14, it being understood that the underreamed portion 16 may be substituted for the void without departing from the principles of the present invention.

Additionally, it should be noted that, in some relatively soft formations, it may not be necessary to form the void 20 or underreamed portion 16 in the wellbore 12.

Figure 6:
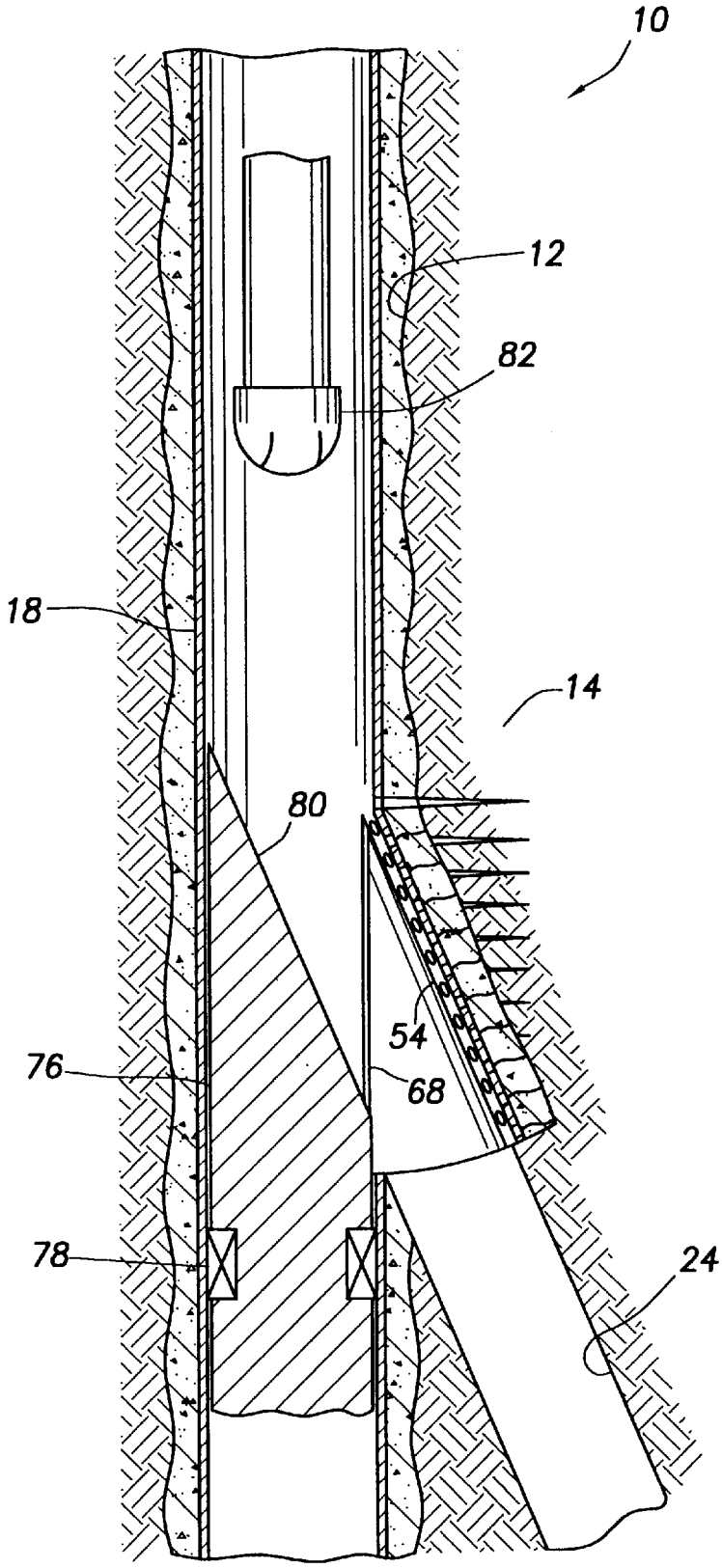
FIG. 6 is a cross-sectional view of the method, in which still further steps have been performed.
Figure 7:
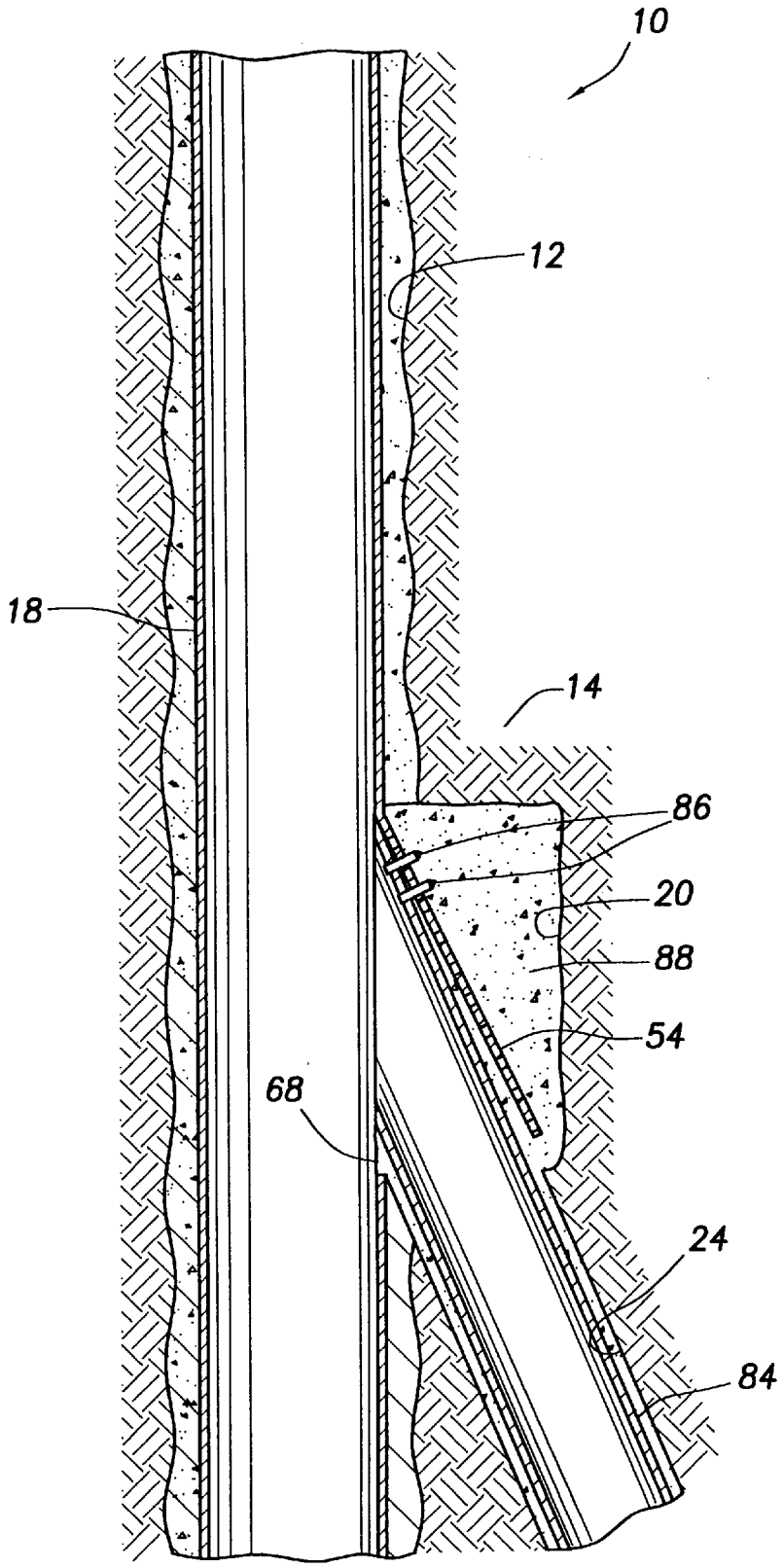
FIG. 7 is a cross-sectional view of the method, in which still further steps have been performed.

To form the void 20 after the casing 18 has been installed, an explosive apparatus 22 is conveyed into the casing and positioned opposite the formation 14 where it is desired to drill a second or lateral wellbore 24 (see FIGS. 6&7). The apparatus 22 may be conveyed into the casing 18 by, for example, a tubular string 26, wireline, slickline, etc. The apparatus 22 is then radially oriented relative to the casing 18 using any conventional technique, such as by use of a highside indicator, gyroscope, orienting nipple, etc., all of which are well known to those skilled in the art.

The apparatus 22 includes a grouping of conventional shaped charges (not shown in FIG. 1), and in this aspect at least, is similar to a perforating gun. However, in the apparatus 22, the shaped charges or other explosive devices are grouped together in a dense pattern so that, when the charges are detonated, the explosive force created thereby will cause compaction, or at least substantial weakening, of the formation 14, thereby forming the void 20, which may be made up of a dense pattern of perforation tunnels, or may be a single cavity formed by compaction of the formation by one or more of the explosive devices. As used herein, the term "compaction" is used to refer to the densification of the formation 14 by reducing its porosity.

As depicted in FIG. 1, the apparatus 22 has been actuated and a dense pattern of perforations 28 may be seen formed through the casing 18. External to the casing 18, the formation 14 has been compacted by the explosive force, thereby creating the void 20.

Figure 2:
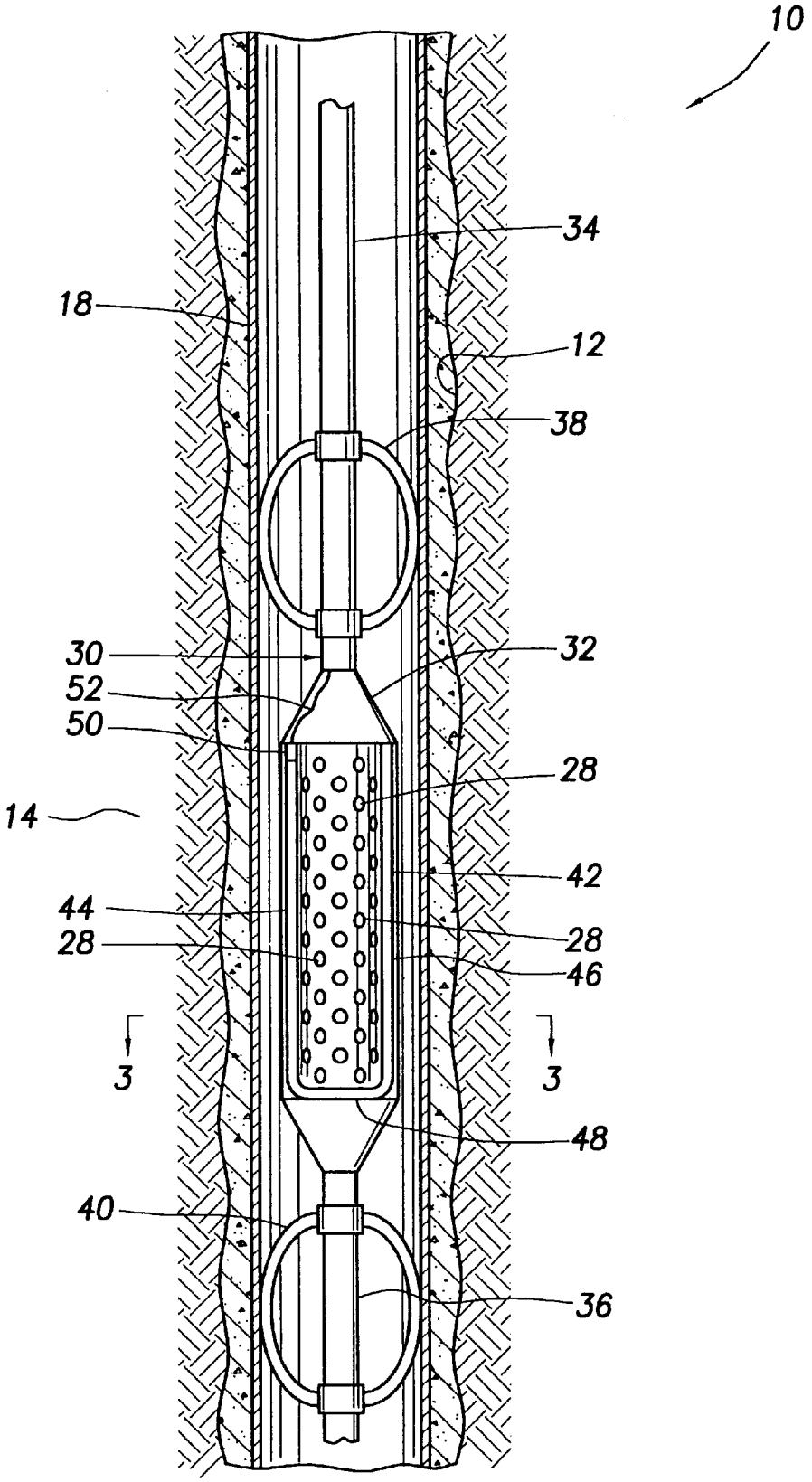
FIG. 2 is a partially cross-sectional and partially elevational view of the method in which further steps have been performed.

Referring additionally now to FIG. 2, a cross-sectional view of the well is shown rotated ninety degrees from that shown in FIG. 1. In this view, the dense pattern of perforations 28 may be more clearly seen. Additionally, another explosive apparatus 30 is shown conveyed into the casing 18. The perforations 28 are visible through the apparatus 30 due to the fact that the apparatus includes a generally open framework 32.

The framework 32 is attached at its upper and lower ends to tubular strings 34, 36, respectively. Of course, the tubular strings 34, 36 could be replaced by a wireline, slickline, or other conveyance. Additionally, the tubular strings 34, 36 may be joined to the tubular string 26, so that the two explosive devices 22, 30 are conveyed into the well together.

The apparatus 30 is positioned in the casing 18 aligned with the perforations 28 as shown in FIG. 2, and centralized in the casing by means of two conventional bow spring centralizers 38, 40. However, it is to be clearly understood that the apparatus 30 could be decentralized within the casing 18 without departing from the principles of the present invention.

Attached to the framework 32 is a linear shaped charge 42 of the type well known to those skilled in the art. For example, U.S. Pat. Nos. 4,116,130 and 4,151,798 describe linear shaped charges having a pressure-tight housing suspended from a framework. The disclosure of these patents are incorporated herein by this reference.

The shaped charge 42 differs significantly from previous types of shaped charges, however, in one respect in that it is shaped to cut an appendage from a sidewall of the casing 18, with the appendage remaining attached to the remainder of the casing, instead of being shaped to sever the casing or otherwise part one element from another. Thus, in the embodiment representatively illustrated in FIG. 2, the linear shaped charge 42 includes two laterally spaced apart generally vertical portions 44, 46 joined by a generally horizontal portion 48. It is to be clearly understood, however, that the linear shaped charge 42 may be otherwise-shaped, such as semi-circular, semi-elliptical, etc., without departing from the principles of the present invention.

A blasting cap or initiator 50 is coupled to the shaped charge 42 for detonating the shaped charge. An electrical conductor 52 may be used to detonate the initiator 50 or the initiator may be detonated by other means, such as percussion, etc.

Figure 3:
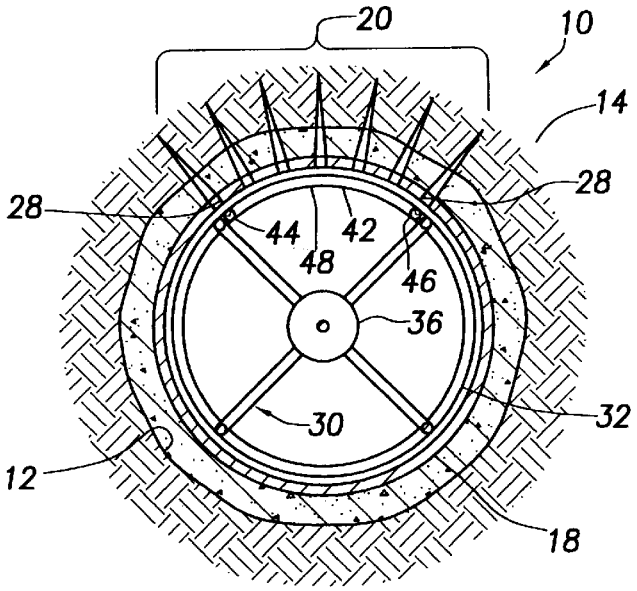
FIG. 3 is a cross-sectional view, taken along line 3—3 of FIG. 2.

Referring additionally now to FIG. 3, it may be clearly seen that the horizontal portion 48 of the shaped charge 42 circumferentially extends, so that it is closely adjacent the sidewall of the casing 18. Likewise, the vertical portions 44, 46 are closely adjacent the casing 18. It will be readily appreciated by a person of ordinary skill in the art that if the shaped charge 42 is detonated while positioned as shown in FIGS. 2&3, a portion of the casing sidewall will be cut partially encircling the perforations 28, and opposite the void 20. In this manner, an appendage 54 (see FIGS. 4–7) is formed from the casing sidewall.

Of course, if the void 20 is not formed, such as when the formation 14 is sufficiently soft that the void is not needed, the shaped charge 42 is oriented with respect to the desired lateral wellbore 24, and the portion of the casing sidewall cut by the shaped charge will not encircle the perforations 28 at all, since the perforations will not be formed through the casing 18.

Figure 4:
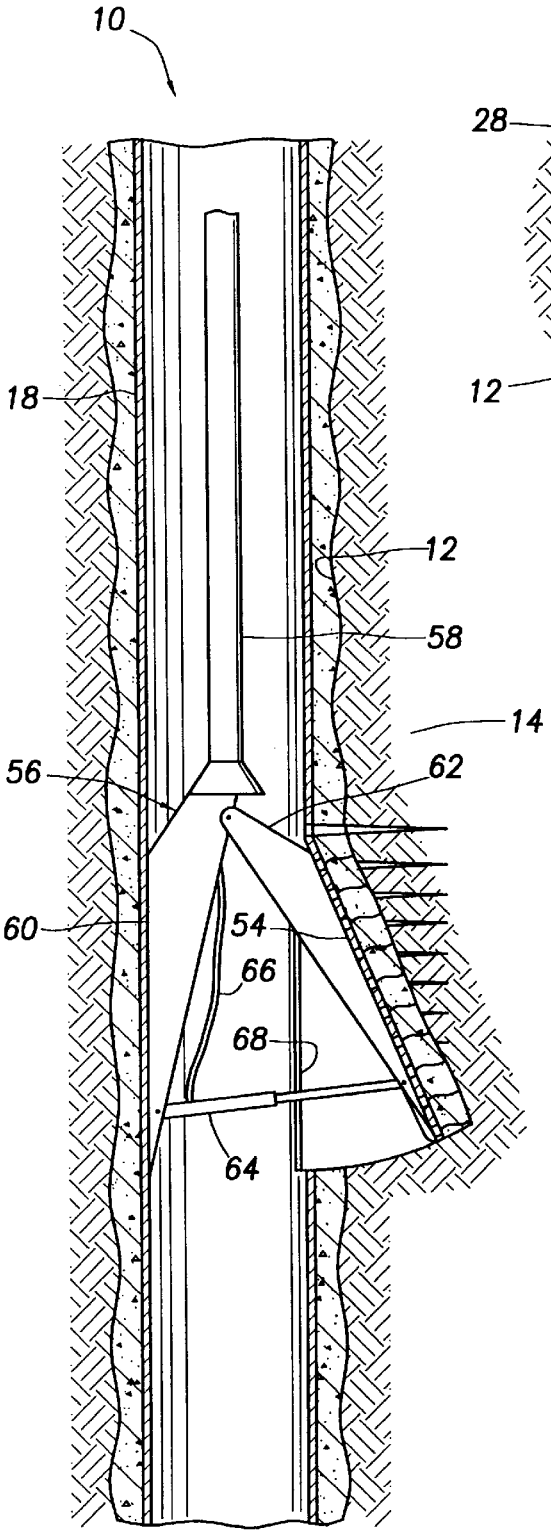
FIG. 4 is a partially cross-sectional and partially elevational view of an optional first apparatus for use in the method.

Referring additionally now to FIG. 4, a cross-section of the well is representatively illustrated rotated ninety degrees from that shown in FIG. 2 The void 20 is again visible as a dense array of perforation tunnels, and it may be clearly seen that the appendage 54 is cut from the casing 18 sidewall as described above, while remaining attached to the remainder of the casing.

Figure 5:
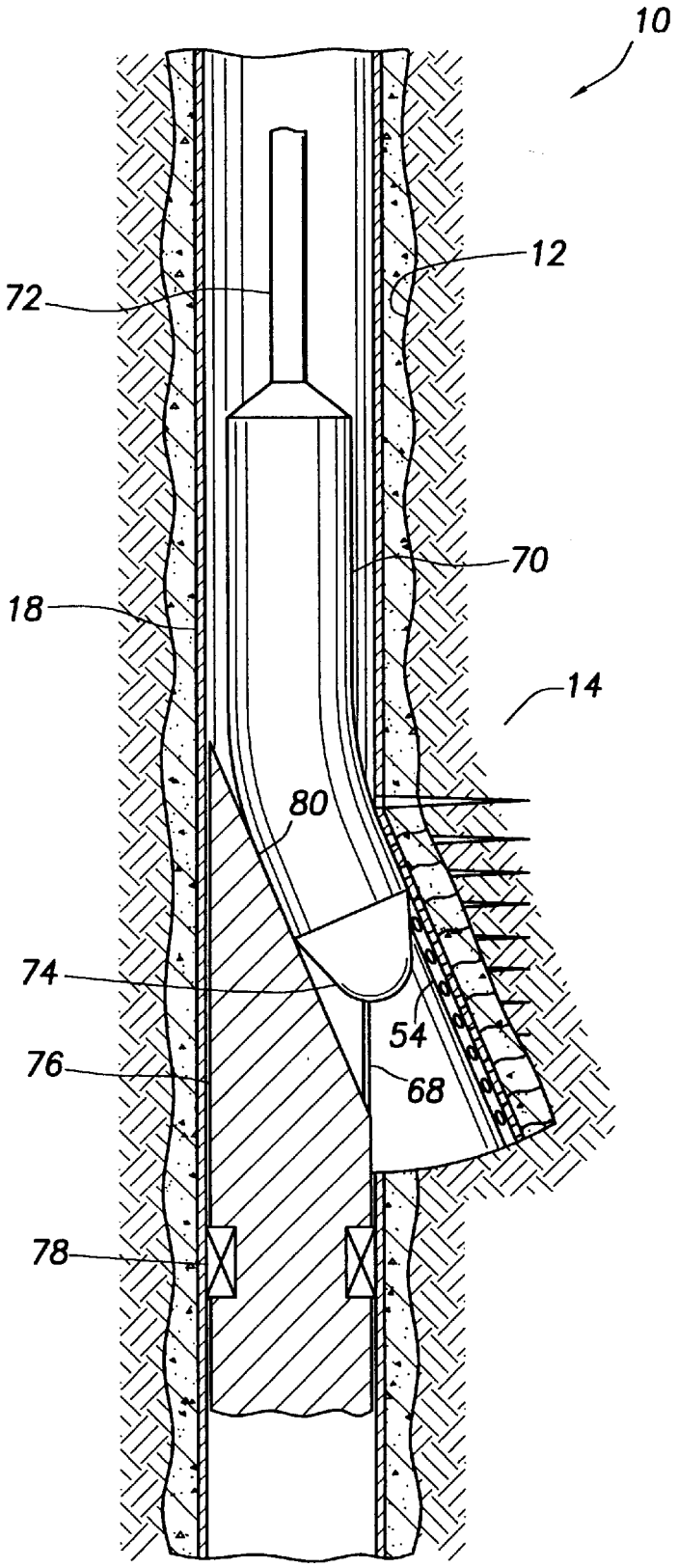
FIG. 5 is a partially cross-sectional and partially elevational view of an optional second apparatus for use in the method.

In FIG. 4 another apparatus 56 is shown positioned in the casing 18 opposite the appendage 54 and void 20. The apparatus 56 is shown as an example of an apparatus usable in the method 10 for displacing or bending the appendage 54 outward relative to the remainder of the casing 18. Another example of an apparatus usable in the method 10 is shown in FIG. 5 and described below.

The apparatus 56 as representatively illustrated in FIG. 4 is conveyed into the well suspended from a tubular string 58. However, the apparatus 56 could be otherwise conveyed, such as by wireline, slickline, etc., without departing from the principles of the present invention. Additionally, the tubular string 58 could be joined to any of the other tubular strings 26, 34, 36 described above for conveyance therewith.

The apparatus 56 includes two arms 60, 62 and a hydraulic cylinder or ram 64 interconnected thereto. In operation, the arms 60, 62 are initially in a closed position, the apparatus 56 is positioned opposite to and aligned with the appendage 54, and the arms are then opened to displace the appendage outward. Opening of the arms 60, 62 is accomplished by applying fluid pressure to the ram 64. Fluid pressure may be delivered to the ram 64 via a hydraulic line 66 interconnected between the ram and the tubular string 58. In this manner, the fluid pressure may be applied to the tubular string 58 at a remote location to cause opening of the arms 60, 62.

Note that when the appendage 54 is bent or otherwise displaced outward into the void 20, an opening 68 is formed through the casing 18 sidewall. Outward displacement of the appendage 54 acts to collapse the perforation tunnels of the void 20. The opening 68 provides access for passing cutting tools therethrough so that the lateral wellbore 24 may be drilled without the need for milling through the casing 18.

Referring additionally now to FIG. 5, the method 10 is representatively illustrated showing another optional means of displacing the appendage 54 outward. In this view it may be seen that a generally cylindrical or tubular mandrel 70 is conveyed into the casing 18 suspended from a tubular string 72. The mandrel 70 as representatively illustrated includes a tapered and rounded nose portion 74. Of course, the mandrel 70 may be shaped otherwise without departing from the principles of the present invention.

The mandrel 70 is deflected laterally into contact with the appendage 54 by a whipstock or other deflection device 76 anchored in the casing 18. The whipstock 76 is anchored in the casing 18 by a packer or other anchoring device 78 attached thereto. An upper laterally inclined surface 80 of the whipstock 76 is oriented to face toward the appendage 54 by any conventional orienting technique.

With the mandrel 70 contacting the appendage 54, a downwardly biasing force is applied to the mandrel to urge the appendage outward. As the appendage 54 displaces outward, the void 20 perforation tunnels are collapsed. The biasing force may be applied, for example, by applying a portion of the tubular string's 72 weight to the mandrel 70.

Referring additionally now to FIG. 6, the appendage 54 is shown bent or otherwise displaced outward into the void 20, thereby forming the opening 68 through the casing 18 sidewall. If however, the void 20 is not formed, the appendage 54 may be bent or otherwise displaced outward directly into the formation 14, the formation being sufficiently soft to permit the appendage to be forced thereinto.

The second or lateral wellbore 24 may now be drilled extending outwardly from the opening 68 by deflecting one or more cutting tools 82 from within the casing 18 outward through the opening 68. Such deflection of the cutting tool 82 may be accomplished by deflecting the cutting tool off of the surface 80 of the whipstock 76. The whipstock 76 may be the same whipstock shown in FIG. 5, or it may be another deflection device.

Referring additionally now to FIG. 7, a tubular member or liner 84 is shown installed in the lateral wellbore 24. The liner 84 may be so installed by conveying it through the casing 18 and outward through the opening 68. A deflection device, such as the whipstock 76 may be used to deflect the liner 84 outward through the opening 68.

The liner 84 is attached to the appendage 54 by means of fasteners or studs 86 driven through the liner and appendage. An apparatus for driving the studs 86 through the liner 84 and appendage 54 is described in U.S. Pat. No. 4,505,018. This patent is incorporated herein by this reference. Of course, other methods of attaching the liner 84 to the casing 18 may be utilized without departing from the principles of the present invention, and it is to be clearly understood that it is not necessary in a method incorporating principles of the present invention for the liner to be attached to the casing.

Note that, by attaching the liner 84 to the casing 18, at least two benefits are achieved. The liner 84 is accurately positioned relative to the casing 18 and the strength of the interconnection between the wellbores 12, 24 is enhanced. To further increase the strength of the wellbore junction and restrict fluid communication between the formation 14 and the casing 18 and liner 84, cement 88 may be flowed into the void 20 and about the liner in the lateral wellbore 24. In FIG. 7 the void 20 is shown as a single cavity, it being understood that, at this point, the void may actually include collapsed perforation tunnels as described above, or the appendage 54 may have been outwardly displaced directly into the formation 14 as also described above.

The foregoing detailed description is to be clearly understood as being given by way of illustration and example only, the spirit and scope of the present invention being limited solely by the appended claims.

What is claimed is:

1. A method of interconnecting first and second wellbores, the method comprising the steps of:

positioning a first tubular member in the first wellbore;

forming an appendage from a portion of a sidewall of the first tubular member, the appendage remaining attached to the remainder of the first tubular member; and displacing the appendage relative to the remainder of the first tubular member.

2. The method according to claim 1, wherein the forming step is performed by cutting the appendage into the first tubular member sidewall portion.

3. The method according to claim 1, wherein the forming step is performed by detonating an explosive charge adjacent the sidewall portion, thereby cutting the appendage from the sidewall portion.

4. The method according to claim 3, wherein the detonating step further comprises providing the explosive charge as a linear shaped charge having a shape conforming to a periphery of the appendage.

5. The method according to claim 1, wherein the displacing step is performed by urging a mandrel against an interior surface of the appendage.

6. The method according to claim 1, wherein the displacing step is performed by positioning an apparatus within the first tubular member and laterally expanding the apparatus.

7. The method according to claim 6, wherein the laterally expanding step is performed by applying fluid pressure to the apparatus.

8. The method according to claim 6, wherein the laterally expanding step is performed by applying fluid pressure to a tubular string attached to the apparatus.

9. The method according to claim 1, further comprising the step of forming a void in the first wellbore, and wherein the displacing step further comprises displacing the appendage into the void.

10. The method according to claim 9, wherein the void forming step is performed by underreaming the first wellbore.

11. The method according to claim 9, wherein the void forming step is performed by detonating an explosive within the first tubular member.

12. The method according to claim 9, wherein the void forming step is performed after the step of positioning the first tubular member within the first wellbore.

13. The method according to claim 1, wherein the appendage displacing step further comprises forming an opening through the first tubular member sidewall portion.

14. The method according to claim 13, further comprising the step of drilling the second wellbore through the opening.

15. The method according to claim 13, further comprising the step of passing a second tubular member outward through the opening.

16. The method according to claim 13, further comprising the step of attaching a second tubular member to the appendage.

17. The method according to claim 16, further comprising the step of positioning the second tubular member within the second wellbore drilled outwardly from the opening.

18. A method of interconnecting first and second wellbores, the method comprising the steps of:

compacting a formation outwardly surrounding a first tubular member positioned in the first wellbore, thereby forming a void in the formation; and bending a portion of the first tubular member into the void, thereby forming an opening through a sidewall of the first tubular member.

19. The method according to claim 18, further comprising the step of attaching a second tubular member to the first tubular member portion.

20. The method according to claim 18, wherein the compacting step is performed by detonating at least one explosive device within the first tubular member.

21. The method according to claim 18, further comprising the step of cutting the first tubular member portion from the first tubular member sidewall.

22. The method according to claim 21, wherein the cutting step is performed by detonating a linear shaped charge within the first tubular member.

23. The method according to claim 18, further comprising the step of drilling the second wellbore by passing at least one cutting tool through the opening.

24. A method of interconnecting first and second wellbores, the method comprising the steps of:

creating a radially outwardly extending recess in the first wellbore prior to drilling the second wellbore;

positioning a first tubular member within the first wellbore;

deforming a sidewall portion of the first tubular member into the recess, thereby forming an opening through the first tubular member sidewall; and deflecting at least one cutting tool outwardly through the opening to form the second wellbore.

25. The method according to claim 24, wherein the deforming step further comprises laterally deflecting a mandrel, thereby causing the mandrel to engage the sidewall portion and bias the sidewall portion outward.

26. The method according to claim 25, wherein the mandrel deflecting step further comprises engaging the mandrel with a deflection device positioned within the first tubular member.

27. The method according to claim 24, further comprising the steps of drilling the second wellbore outwardly from the opening, and positioning a second tubular member in the second wellbore.

28. The method according to claim 27, further comprising the step of attaching the second tubular member to the first tubular member.

29. The method according to claim 28, wherein the attaching step further comprises fastening the second tubular member to the sidewall portion.

30. The method according to claim 29, wherein the fastening step further comprises driving a fastener through the second tubular member and the sidewall portion.

* * * * *